United States Patent [19]

Guerber

[11] 4,185,703

[45] Jan. 29, 1980

[54] APPARATUS FOR PRODUCING DEEP BOREHOLES

[75] Inventor: Paul L. Guerber, Drancy, France

[73] Assignee: Coyne & Bellier, Bureau d' ingenieurs Conseils, Paris, France

[21] Appl. No.: 908,969

[22] Filed: May 24, 1978

Related U.S. Application Data

[62] Division of Ser. No. 749,833, Dec. 10, 1976, Pat. No. 4,116,285.

[30] Foreign Application Priority Data

Jun. 18, 1976 [FR] France ..... 76 18585

[51] Int. Cl.[2] ..... C09K 7/00; E21C 7/06

[52] U.S. Cl. ..... 175/17; 175/70; 175/72; 175/107; 175/104

[58] Field of Search ..... 175/17, 91, 95, 104, 175/105, 106, 107, 334, 319, 11; 299/59, 57

[56] References Cited

U.S. PATENT DOCUMENTS

| | | | |
|---|---|---|---|
| 678,045 | 7/1901 | Seltner | 175/91 X |
| 1,396,625 | 11/1921 | Corrigan | 175/17 X |
| 1,419,068 | 6/1922 | McFadden | 175/319 X |
| 1,877,225 | 9/1932 | Capeliuschnicoff | 175/319 |
| 2,595,126 | 5/1952 | Causey | 175/96 |
| 3,195,661 | 7/1965 | Jackson et al. | 175/95 |
| 3,509,949 | 5/1970 | Kukihara | 175/91 X |
| 3,743,037 | 7/1973 | Bulakh et al. | 175/334 |
| 3,773,121 | 11/1973 | Ikeda | 175/104 X |
| 3,935,910 | 2/1976 | Gaudy et al. | 175/17 |
| 3,945,445 | 3/1976 | Ikeda | 175/319 |

*Primary Examiner*—James A. Leppink
*Assistant Examiner*—Richard E. Favreau
*Attorney, Agent, or Firm*—Christel, Bean & Linihan

[57] ABSTRACT

This invention concerns the production of very deep boreholes. A rotary drilling tool is suspended at one end of a very long line of supporting elements such as a cable. During at least the entire duration of the drilling operation, the borehole is filled at least partly with at least one substance which remains in a liquid state and has a density greater than the mean density of the drilled ground strata. Thus any infiltrations in the borehole and the drilling debris move naturally upwards to the free surface of the liquid substance filling the borehole.

9 Claims, 11 Drawing Figures

APPARATUS FOR PRODUCING DEEP BOREHOLES

This is a division of application Ser. No. 749,833 filed Dec. 10, 1976, now U.S. Pat. No. 4,116,285 issued Sept. 26, 1978.

The present invention concerns a process of producing boreholes down to very great depths of several kilometers or tens of kilometers.

The ability to produce very deep boreholes can be usefully employed in very many advantageous fields: investigating and exploiting very deep strata, more particularly oil-bearing strata; geological and seismic studies, tapping geothermal energy etc.

Various processes are already known for carrying out deep drilling. There is the rotary drilling process, which makes it possible at the present time to achieve the greatest depths, of about 3500 m; this process uses a rotary tool, which is moved downwards in the borehole at the lower end of a line of tubes through which a strong current of water under pressure is injected into the said borehole; the debris is then discharged by water through the space between the walls of the borehole and the line of tubes. This known process, likewise the other known processes, in most cases require the borehole to be lined with casing tubes as it progresses, that is to say tube sections of an external diameter near to that of the borehole have to be put down in succession in order to prevent the walls from crumbling inwards and/or to prevent the borehole being invaded by infiltrations.

The well known rotary drilling process which has just been described and which is used in particular for oil well drilling operations, makes it possible to reach only limited depths, for the following reasons: first of all the line of tubes at the end of which the rotary drilling tool is moved downwards has to be given an internal cross-section sufficiently large to allow the passage of a relatively considerable flow of water to permit the entrainment of debris towards the surface; now, the weight of a line of tubes of this kind rapidly becomes prohibitive in the case of very deep boreholes. Furthermore the setting out of casing tubes in very deep boreholes is an extremely delicate operation and in any case is extremely expensive, more particularly since the tubes are usually not recoverable even when the borehole has ceased to be of any interest.

A first object of the invention is to make it possible to produce boreholes to depths which may be as much as several kilometers or even tens of kilometers, by a process which has neither the limitations nor the disadvantages of hitherto known drilling processes.

A second object of the invention is a process for drilling the ground to a very great depth, consisting in, as the drilling operations progresses downwards, filling the borehole at least partly, with at least one substance which at all points situated within said borehole, remains in the liquid state and has a density greater than the mean density of the drilled ground strata, so that debris and possible infiltrations in said borehole move naturally up to the free surface of the liquid filling said borehole.

Since debris moves up to the surface of the said liquid by natural flotation owing to the high density of the liquid material filling the borehole, the process according to the present invention obviates the necessity to have to inject considerable quantities of washing water into the bottom of the borehole, which makes it possible to replace the line of tubes carrying the rotary tool in the case of the known rotary drilling process mentioned hitherto, by a supporting element of much less linear weight, such as one or more cables or chains. Furthermore, from a certain depth at least, the column of liquid which fills the borehole produced by the process according to the present invention exerts on the walls of the said borehole a hydrostatic pressure which opposes the thrust of the surrounding strata and which in most cases obviates any need to use difficult and expensive tube casing operations.

In a preferred embodiment of the process according to the present invention, a borehole filling substance is used which is solid under normal pressure and temperature conditions, in other words surface conditions, and the said filling substance is kept in the liquid state at all points situated within the borehole by locally supplying suitable amounts of heat, which may advantageously be brought about by electrical resistances fixed at suitable points on the supporting elements of the rotary tool. This arrangement on the one hand offers the advantage of allowing a large range of filling substances to be used, under conditions which will be stated hereinafter. On the other hand, the use of a filling substance which is kept in the liquid state in the borehole only by artificial means offers the important advantage of providing for filling in and stopping the cracks in the walls of the boreholes, particularly so as to consolidate the wall regions which are fissured or cracked or even partly collapsed, without any need to resort to the use of casing tubes in these defective zones of the borehole. In fact the liquid substance filling the borehole enters any cracks which there may be in the borehole walls and, if these cracks are relatively deep, the filling material which enters them ceases to be subjected to the locally supplied heat, specially to the heating effect of the nearest electrical resistance, so that the said infiltrated filling substance returns again to solid state in the cracks which it therefore fills up, consolidating the walls of the borehole.

For drilling deep boreholes in the earth this preferred embodiment of the process according to the present invention has to take into account the laws of increasing earth temperature and increasing pressure as the depth of the borehole increases; in fact it is known that the underground strata of the earth exhibit a fairly rapid heat gradient, and as a result the filling material in a borehole produced by the process according to the present invention receives fron the drilled underground strata quantities of heat which become all the greater in proportion as the drilled strata are deeper. Furthermore, the melting temperature of the filling substance at any specific point in the borehole depends on the pressure prevailing at that point, and usually increases with the said pressure; now, this pressure and consequently the melting temperature also, increase with the depth of the point in question in the substance filling the borehole (if one disregarded the pressure of the ground, the purely hydrostatic pressure of the liquid substance filling the borehole would increase linearly with the depth and proportionally to the high density of the said filling substance; this density also itself depends on the said pressure and therefore tends to decrease when the depth and the temperature increase).

For all these reasons, process according to the present invention for drilling underground strata is preferably carried out in the following way: a plurality of superjacent drilling sections are filled respectively with a same plurality of different filling substances each chosen so as to remain liquid at all points of the respective section of the borehole, taking into account the laws governing the increase in earth temperature and the increase in pressure with increasing depth in the borehole.

To accelerate the natural upward movement by flotation of the debris from the bottom of a very deep borehole different means may be used according to the present invention.

First of all it is possible to maintain the borehole filling substance, at least in the vicinity of drilling tools, at a temperature slightly below its boiling point so that when its boiling commences this will result in the production of bubbles of gas some of which may be absorbed by solid particles of debris so as to accelerate the upward movement of such particles, and which all tend to create in the liquid filling substance an upwardly flowing stream carrying along solid debris towards the free surface of the said filling substance.

According to a first variant, the liquid filling substance of the borehole is circulated during the drilling operation by pumping means which are set up at the ground surface and which comprise a suction duct immersed in the liquid filling the said borehole and a delivery duct, and by a conduit arranged approximately vertically in the said borehole and having an upper end connected to the said delivery duct and a lower end opening near the bottom of the said borehole. Since the upward movement of debris towards the surface of the liquid is brought about substantially by flotation, the pump may have a relatively low rate of through flow and the conduit arranged in the borehole may be given a relatively small internal diameter. Since it is also possible to use a flexible conduit, its weight and expense are very much less than those of a line of tubes such as is used in the known rotary drilling process mentioned hereinbefore.

In a second variant, a fluid of a density below that of the borehole filling liquid is injected, under pressure if necessary, into the bottom of the borehole during the drilling operation. This fluid could be a liquid of lower density than that of the filling liquid; but it is preferable to use a gas and more particularly compressed air, which, with a minimum rate of flow, promotes the upward movement of solid debris towards the surface in the same way as the bubbles of filling liquid did in the case of the embodiment of the present invention mentioned hereinbefore. Again in this second variant the compressed air can be brought to the bottom of the borehole by a flexible conduit of small cross-section and therefore of light weight and of an inexpensive type.

A further object of the invention is to provide an apparatus for drilling the earth to a very great depth, which comprises at least one a rotary drilling tool with an incorporated motor, means for moving the said tool downwards in the borehole, the said means comprising a line of supporting elements of great length having one end fixed to the said tool and a cross-section which increases from its end fixed to the said tool, electrical resistances fixed at specific points on the said line of supporting elements, at least one electrical able for supplying electrical power to the said resistances from the ground surface, and means for supplying the said motor from the ground surface.

By way of example, a description will now be given, and illustrated diagramatically in the accompanying drawings, of several embodiments of the present invention.

For drilling a borehole which may have a depth of 15,000 meters for example, by the process according to the present invention, it would be possible to use a rotary tool of a known type operated for example by a built-in electrical motor and comprising a single drilling element such as an abrasive disc or ring rotating about a vertical axis so as to drill a hole with a circular cross-section. However, a known rotary tool of this kind has the disadvantage of developing a reaction torque and compensation has to be provided for this in some way or other. In cases where a rotary tool of this kind is suspended at the lower end of a line of tubes the last tube of the line is sufficiently rigid to stand the reaction torque mentioned without being twisted thereby. But this would not be the case where the rotary tool in question is suspended at the end of a line of supporting elements such as cables, chains etc, which generally do not have sufficient transverse rigidity to stand the reaction torque but are twisted thereby. However, it is possible to improve these known rotary tools so as to permit use in carrying out the process according to the present invention, by adding means for standing or cancelling the reaction torque. A means of this kind may be for example a flywheel which the tool motor drives in rotational movement in a direction opposite to the rotation of the abrasive disc or ring.

The accompanying drawings show various embodiments of rotary tools which have been specially designed so as to obviate the disadvantages of the reaction torque and which consequently can be moved downwards into the borehole at the end of a line of supporting elements which have transverse flexibility such as cables, chains etc. The common characteristic of these embodiments of rotary tools for carrying out the drilling process according to the present invention consists in that they are arranged so as to drill a hole which has a non-circular cross-section.

Figure 1:
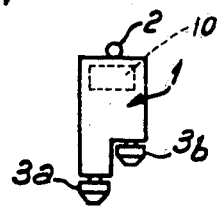
FIG. 1 and FIG. 2 show respectively a view in elevation and from below of a first embodiment of a rotary tool for carrying out the drilling process according to the present invention.
Figure 2:
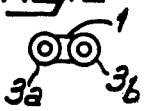

The embodiment illustrated in FIG. 1 and in FIG. 2 comprises a casing 1 provided at its upper portion with an attachment element 2. This casing 1 includes in a manner known per se, which does not therefore have to be shown in detail, an electric motor 10 of a suitable type and a reduction gear provided with two parallel output shafts whose ends project below the casing 1 at different levels, as FIG. 1 shows; there are fixed on the ends of these two output shafts of the reduction gear toothed rings 3*a* and 3*b* respectively which are thus driven in rotational movement in the same direction or in opposite directions about parallel vertical axes when the casing 1 is suspended by its attachment element 2 to the end of a line of supporting elements (not shown) such as a cable or a chain. The transverse contour of the borehole formed with a tool of this kind is substantially oval.

Figure 3:
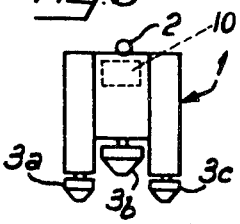
FIG. 3 and FIG. 4 show corresponding views of a second embodiment of a rotary tool.
Figure 4:
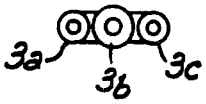
Figure 5:
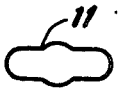
FIG. 5 shows the transverse contour of a borehole drilled with the rotary tool illustrated in FIG. 3 and FIG. 4.

The embodiment illustrated in FIG. 3 and FIG. 4 differs from that described previously only in that the reduction gear arranged in the casing 1 comprises a third output shaft on which a third toothed ring 3*c* is secured at the same level as the ring 3*a;* the central ring 3*b* has preferably a diameter greater than that of the two side rings 3*a* and 3*c*. With this tool it is possible to produce a borehole whose transverse contour 11 is shown diagrammatically in FIG. 5.

Figure 6:
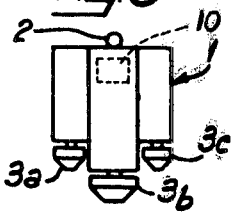
FIG. 6 and FIG. 7 show respectively a view in elevation and from below of a third embodiment of a rotary tool for carrying out the drilling process according to the present invention.
Figure 7:
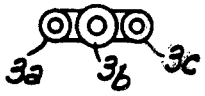
Figure 8:
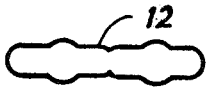
FIG. 8 shows the transverse contour of a borehole which may be drilled by using two juxtaposed tools such as that illustrated in FIG. 6 and FIG. 7.

The embodiment illustrated in FIG. 6 and FIG. 7 differs from that illustrated in FIG. 3 and FIG. 4 in that the central ring 3*b* is arranged at a level lower than that of the two side rings 3*a* and 3*c*. By arranging two drilling tools such as that illustrated in FIG. 6 and FIG. 7 closely side by side it is possible to produce for example a borehole with an elongated cross-section having the contour 12 shown in FIG. 8.

Figure 9:
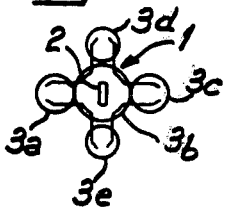
FIG. 9 is a diagrammatic view showing a fourth embodiment of a rotary tool for carrying out the drilling process according to the present invention.

The plan view shown in FIG. 9 shows a tool whose reduction gear comprises five vertical output shafts arranged respectively at the center and at the corners of a square so as to be able to drive a central ring 3*b* and four side rings 3*a*,3*c*, 3*d* and 3*e* respectively.

Figure 10:
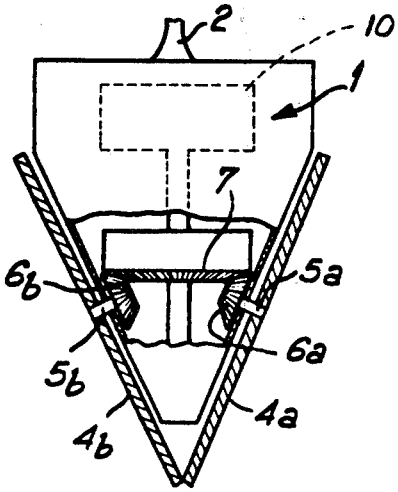
FIG. 10 is a view in elevation and in partial section of a fifth embodiment of a rotary tool.

In the embodiment illustrated in diagrammatic manner in FIG. 10, the toothed rings are replaced by two abrasive discs 4*a* and 4*b* whose shafts 5*a* and 5*b* extend by means of bearings not shown here through the lateral walls of the casing 1 in directions such that the two abrasive discs 4*a* and 4*b* form an acute angle and are almost in contact with one another at their respective lower edges; their shafts are driven in rotational movement by means of bevel gearwheels 6*a* and 6*b* and a toothed ring 7 fixed on the single output shaft of the reduction gear which is arranged along with the electric motor in the said casing 1. A variant of the tool illustrated in FIG. 10 comprises three abrasive discs.

By way of a variant, a toothed ring or a third abrasive disc can be arranged on the lower end of the casing 1 of the tool shown in FIG. 10.

In preceding embodiments the toothed rings or abrasive discs may be replaced also by bucket chains of known type.

Figure 11:
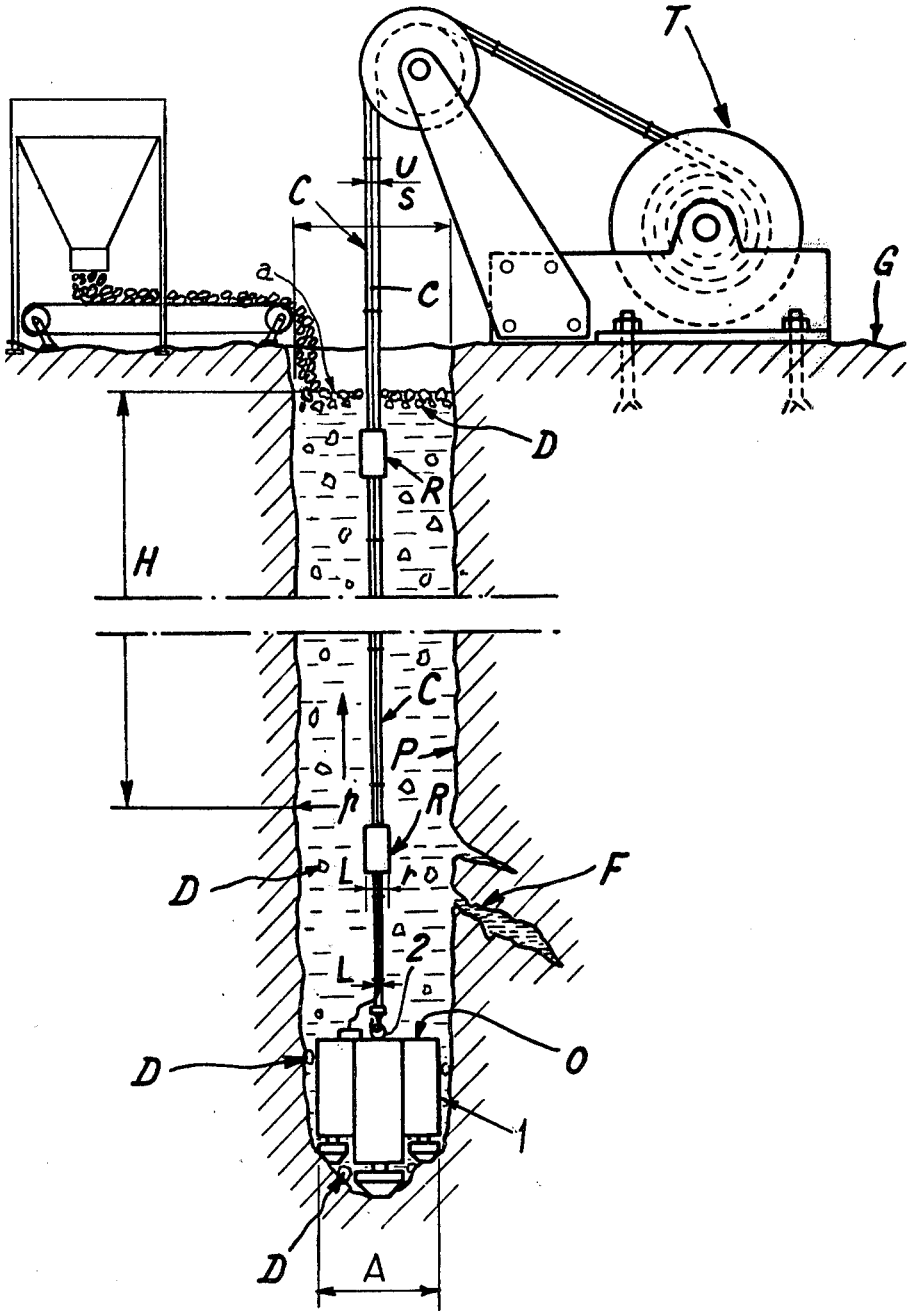
FIG. 11 is a view in elevation of a preferred embodiment of an apparatus according to the present invention.

To constitute a drilling apparatus according to the present invention, such as that which is illustrated in FIG. 11, a rotary tool O of one of the types previously considered and having a cross-section A is suspended by its attachment element 2 at the end of a supporting element C of great length, the cross-section L thereof increasing from its lower end which is fixed to the said tool O; to an upper end value U this supporting element C may be constituted for example by a cable 15,000 meters in length, whose cross-section near the point of attachment 2 of the tool O amounts to for example 1 $cm^2$, and 8,000 meters further on amounts to for example 12 $cm^2$ etc. Electrical resistances R of suitable values each having a cross sectional area r are fixed at predetermined points of the said cable C; the apparatus is also provided with electrical cables c for the supply of the aforesaid resistances R and the electric motor built into the drilling tool O. The dimensioning and the arrangement of the electrical resistances mentioned hereinbefore R will become clear from the following.

To excavate for example a borehole 15,000 meters in depth by the process according to the present invention, using the apparatus which has just been described, the following procedure is adopted for example:

First of all by conventional techniques a borehole of at the most 2,000 meters in depth is drilled, with a sufficient cross-section S to allow the downward movement therein of the drilling tool O by means of a winch T (FIG. 11). If, as is usually the case, the underground layers situated at a depth of more than 2,000 meters have a mean density which itself is lower than 3, the bottom of the borehole, which has been contacted by the drilling tool O moved downwards at the end of the supporting element C, is then filled with solid pieces of antimony trichloride by suitable means, for example that designated X in FIG. 11. The temperature which prevails at the bottom of the borehole being near 70° C., the lower electrical resistance R of the drilling apparatus is supplied with a sufficient electrical power to bring the antimony trichloride to its melting point, which is only 72° C. at atmospheric pressure. The electric motor of the drilling tool O is supplied, and its rings or abrasive discs then attack the bottom of the borehole, filled with melted antimony trichloride l. To carry on with the drilling it is advantageous then for at least the entire lower portion of the initial borehole to have also been filled with antimony trichloride in solid state, which is brought to melting point by a local supply of a suitable amount of heat from the electrical resistances R which are distributed along the supporting element C of the drilling tool O.

Thus, as has already been indicated, the work of the drilling tool O is facilitated by the fact that the tool is immersed in a liquid l. On the other hand, earth or rock debris D and also any infiltrations which occur, generally water, move upwards naturally to the free surface a of the melted antimony trichloride l because of their lower density (lower than 3). These debris and infiltrations D are then particularly easy to remove if the free surface a of the liquid antimony trichloride l is near the surface G of the ground. However, it is also possible to "skim" the said free surface a even where this is situated at a certain depth, by using simple well-known means. If some of the walls P of the lower portion of the borehole below 2,000 meters, which is filled with liquid antimony trichloride, comprise cracks or collapsed portions F, the liquid antimony trichloride l enters these immediately and, as soon as its temperature decreases, it solidifies therein and this has the effect of stopping any such cracks or fissures F and consolidating the walls P of the borehole, preventing or reducing any infiltrations. Furthermore, as the drilling progresses, the liquid antimony trichloride l exerts on the walls P of the borehole a pressure p which is proportional to the vertical distance H of the free surface l and the density of the liquid antimony trichloride l; this hydrostatic pressure p opposes the pressure of the ground and therefore ensures the stability of the walls P of the borehole without any need to provide casing tubes for these walls. However, it should be noted that the increase in this hydrostatic pressure p with the depth H produces an increase in the melting temperature of the antimony trichloride l, whose liquid state can be maintained only by providing an increasing amount of heat as the depth H increases.

The drilling in liquid antimony trichloride can be continued, if there are no leakages, up to a depth slightly less than that where there exists underground a temperature in the vicinity of its boiling point (230° C. at atmospheric pressure) which again depends on the hydrostatic pressure p and consequently the depth H. The use of liquid antimony trichloride makes it possible to drill to a depth H of at least 4,500 meters, where there is a temperature in the vicinity of 217° C.

In order to continue the borehole below this last depth, pieces of selenium which are solid under normal temperature and pressure conditions are dropped on to the free surface a of the liquid antimony trichloride. The density of selenium being in the vicinity of 4.6, that is to say greater than that of the antimony trichloride in liquid form, the selenium pieces fall slowly to the bottom of the borehole, which is then at a depth of about 4,500 meters; the temperature of 217° C. which the solid selenium encounters in this region makes the selenium melt, and makes it possible to continue the drilling work of the tool O in a liquid medium, possibly with local supply of small heat amounts by means of the electrical resistances R fixed to the supporting element or suspension cable C for the drilling tool O. The drilling in the liquid selenium can be continued up to a depth at which a temperature slightly below the boiling point of selenium (689° C. at normal pressure) is reached; thus it is possible to reach a depth of about 9,500 meters. A final depth of about 15,000 meters can then be reached by using no longer selenium but tellurium, which has a density of 6.2, that is higher again (melting point equal to 450° C. and boiling temperature equal to 1390° C. at atmospheric pressure).

In cases where the drilled strata have a particularly low average density and where the risk of pollution are negligible, it is possible in the first phase of the drilling process described hereinbefore to use not antimony trichloride which has a density of 3 but sulphur which has a density of 2; its melting temperature (120° C.) and boiling temperature (444° C.) at normal pressure are such that the liquid sulphur can be used for carrying out the drilling method according to the present invention at depths of between 3,000 and 7,200 meters.

It will be clear from the foregoing that under certain conditions of use the carrying out of the drilling process according to the present invention may require no local supply of heat to make the filling substance remain in the liquid state, particularly at certain depths. However, in most cases it is very advantageous to provide the necessary means for these local supply of heat even if these means are not all permanently used. In fact it is advantageous for the liquid filling substance to be maintained throughout the borehole at a temperature considerably above its solidification temperature, on the one hand in order to reduce the viscosity of the said liquid substance, since high viscosity would slow down the upward movement of debris and any infiltrations, and on the other hand to facilitate the establishment in the said liquid substance of upwardly travelling currents which carry with them the debris and any infiltrations up towards the liquid free surface. According to one particular embodiment of the process according to the present invention it is even advantageous to keep the liquid substance filling the borehole at least in the vicinity of the drilling tools, at a temperature just slightly below its boiling point; under these conditions in fact there is a formation of a large number of vapour bubbles of the filling substance, producing upward currents in the liquid mass, and these bubbles may even be adsorbed by the solid particles of debris whose upward movement they accelerate.

Other means have also been indicated hereinbefore whereby the upward travel of debris and any infiltrations which have taken place towards the free surface of the liquid filling substance can be accelerated. The injection of compressed air at the bottom of the borehole near to the drilling tool is one of these means and a particularly effective one.

Of course the drilling process according to the present invention can be carried into effect by using filling substances which differ from those previously mentioned provided that they have in the liquid state a density considerably above the mean density of the strata which are being drilled. It is possible to use more particularly as the filling substance antimony Sb (density: 6.8; melting temperature: 630° C. and boiling temperature: 1460° C. at normal pressure), black powder $Sb_2S_3$, stibine $Sb_2O_3$, red powder for vulcanisation $Sb^2O_5$, sodium seleniate $SeO_4Na_2$, tellurite $TeO_2$, cryolite, silica gel, metals with a low melting point, or even glasses or crystals. In these latter cases, it is known that the density of glasses is 2.5 to 2.6 and that the density of crystals is 2.9 to 3.3, and their melting temperatures under normal pressure are between 700° and 900° C. The use of ordinary glass makes it possible to avoid using antimony trichloride and therefore, provided that intensive heating is made available, to use a very easily obtained and non-polluting filling substance. Thus is is possible to begin the drilling with antimony trichloride, then continue it with solid pieces of glass or crystals which, at the temperatures which are encountered, are more dense than liquid antimony trichloride, in which they can therefore move downwards, whilst being capable of hardening in fissures in the walls between 200° and 700° C.

Instead of being operated by a built-in electric motor, the rotary tool used for carrying out the drilling process according to the present invention can be operated by a turbine which is also built into the casing of the rotary tool and is supplied with a fluid, for example a gas under pressure or a liquid, which is brought from the ground surface by a suitable conduit. The fluid which has operated the turbine can be collected and returned to the ground surface by a riser conduit or may be discharged at the bottom of the borehole. In the latter case, preferably a liquid of lower density than the density of the filling liquid substance will be used, so as to prevent the driving fluid from accumulating in the bottom of the borehole; the simplest solution consists in using compressed air as the driving fluid. According to one variant, the driving fluid of the turbine is constituted by the filling substance, itself which is brought from the surface in the liquid state by a conduit and then is discharged at the bottom of the borehole after having operated the said turbine. The rotary tools operated by a turbine have the important advantage over those which are operated by an electric motor that they do not present any problems of electrical insulation, the solution to such problems being likely to be relatively complicated under the high pressure and temperature conditions in which tools are used for carrying out the drilling process according to the present invention.

There are very many possible future uses of earth drilling processes producing boreholes reaching depths of several thousand meters or several tens of thousands of meters. In addition to scientific uses, there may simply be mentioned research into and the exploitation of strata, more particularly oil-bearing strata, and the recovery of geothermal energy, by various means and processes.

In most cases, the exploitation of a deep borehole produced by the process according to the present invention requires first of all emptying it of the liquid filling substance which it contains. This emptying should not present any very complicated problem since the said filling substance is constantly kept in the liquid state. This previous removal of the filling liquid may be necessary more particularly where the borehole gives access to a deep bed of ore or petroleum, or a pocket of hot water, steam or gas, the tapping of which makes it possible to supply for example an installation for the recovery of geothermal energy.

Other uses are possible for deep boreholes produced by the process according to the present invention, which do not require the removal of the liquid filling the borehole but on the contrary use this liquid, specially as a heat exchanger to recover geothermal energy.

The drilling process according to the present invention may also be carried out for drilling sea beds. When only shallow depths are concerned, the process can be carried out from an artificial island of any known type. If the site or requirements justify the creation of an island, preferably there will be used for this purpose a known process which is based on the use of a non-woven material, bags of cement grout, and various materials collected near the site. In the case of sea beds of medium depth, preferably a rigid pipe will be planted in the zone of the sea bed which is to be drilled, the upper portion of this rigid pipe having to extend to a sufficient height above the surface of the sea to allow drilling operations to be carried out. In this latter case, drilling operations are carried out from a floating platform which is anchored and level with which the upper end of the pipe terminates. As soon as this rigid pipe is in position, the upper portion can be replaced over a length of 40 to 50 meters or more by a large flexible tube mounted on ballast tanks, which makes it possible either to make it float or remain below the water so as not to hinder navigation.

In all cases, the cost price of boreholes drilled by the process according to the present invention is substantially equal to half the price of boreholes drilled by previously known processes.

The present invention is not limited to the embodiments described hereinbefore; all modifications thereto, wherein at least some of the means described are replaced by functionally equivalent means, are also within the scope of the present invention.

I claim:

1. Apparatus for drilling very deep boreholes in the ground without tubing, comprising at least one rotary drilling tool with a built-in motor, said drilling tool having a cross-sectional area A substantially equal to the cross-section S of the hole to be drilled, means for moving said tool downwards in the borehole, said means comprising a line of supporting elements of great length having a lower end fixed to said tool said line of supporting elements having a cross-sectional area which increases from a lower end value L much smaller than A and S to an upper end value U larger than L but much smaller than A and S, electrical resistances fixed at predetermined points on said line of supporting elements, said electrical resistances also having a cross-sectional area r much smaller than A and S, at least one electrical cable for supplying electrical power to said resistances from the ground surface, means for supplying said motor from the ground surface, and means for filling the borehole with at least one melting substance.

2. Apparatus according to claim 1, wherein the built in motor of the rotary tool is an electric motor and its supply means comprises an electric cable extending in said borehole from the ground surface.

3. Apparatus according to claim 1, wherein the driving motor of the rotary tool is a turbine and its supply means comprises a conduit for driving fluid, said conduit extending in said borehole from the ground surface to said turbine.

4. Apparatus according to claim 3, wherein the driving fluid is discharged by the turbine into the bottom of said borehole.

5. Apparatus according to claim 4, wherein the driving fluid of the turbine is constituted by a same liquid substance as the melting substance filling the borehole.

6. Apparatus according to claim 1, wherein the rotary drilling tool has a non-circular cross-section.

7. Apparatus according to claim 6, wherein the drilling tool comprises a plurality of rotary drilling elements some at least of which have axes of rotation inclined relatively to the vertical direction.

8. Apparatus according to claim 6, wherein the drilling tool comprises a plurality of rotary drilling elements having vertical axes of rotation, spaced from one another.

9. Apparatus according to claim 7, wherein some at least of the various rotary elements of the drilling tool are offset vertically relatively to one another.

* * * * *